US006460682B1

(12) United States Patent
Agier et al.

(10) Patent No.: US 6,460,682 B1
(45) Date of Patent: Oct. 8, 2002

(54) ROUTING DEVICE FOR GROUPING TWO STREAMS OF FLAT OBJECTS, SUCH AS MAIL ENVELOPES, INTO ONE STREAM

(75) Inventors: François Agier, Bourg-les-Valence; Vincent Grasswill, Montelier; Christian Laumond, Chabeuil, all of (FR)

(73) Assignee: Mannesmann Dematic Postal Automation S.A., Gentilly (FR)

( * ) Notice: Subject to any disclaimer, the term of this patent is extended or adjusted under 35 U.S.C. 154(b) by 0 days.

(21) Appl. No.: 09/869,037

(22) PCT Filed: Dec. 21, 1999

(86) PCT No.: PCT/EP99/10160

§ 371 (c)(1),
(2), (4) Date: Sep. 13, 2001

(87) PCT Pub. No.: WO00/39012

PCT Pub. Date: Jul. 6, 2000

(30) Foreign Application Priority Data

Dec. 24, 1998 (FR) ..... 9816427

(51) Int. Cl.[7] ..... B65G 47/12
(52) U.S. Cl. ..... 198/448; 271/9.13
(58) Field of Search ..... 198/443, 448; 271/9.13, 9.1

(56) References Cited

U.S. PATENT DOCUMENTS 2,028,235 A 1/1936 Needham
4,696,464 A * 9/1987 Gammerler ..... 271/9.13 X
5,421,699 A * 6/1995 Guiles et al. ..... 271/9.13 X
5,617,804 A * 4/1997 Savio ..... 271/9.13 X

FOREIGN PATENT DOCUMENTS

| | | |
|---|---|---|
| DE | 12 55 673 B | 12/1967 |
| DE | 21 45 270 A | 3/1973 |
| DE | 43 15 053 A | 11/1994 |
| EP | 0 719 883 A | 7/1996 |

* cited by examiner

*Primary Examiner*—James R. Bidwell
(74) *Attorney, Agent, or Firm*—Sughrue Mion, PLLC

(57) ABSTRACT

A routing device that allows two incoming streams of flat objects on two upstream conveyors to converge symmetrically at a small angle toward a downstream conveyor and be grouped into a single stream of flat objects, such that the two upstream conveyors paths form a Y-shaped structure with the conveying path defined by the downstream conveyor. The upstream conveyors each have a press belt (7; 7') stretched over elastically deformable wheels (10, 11, 12, 10', 11', 12') with fixed axles and a backing belt (4; 4') against which the press belt presses to convey the flat objects. The press belts (7, 7') of the upstream conveyors meet at a gripping point constituting the entry to the downstream conveyor and are pressed against one another downstream of the gripping point by two elastically deformable wheels (11, 11') with fixed axles for defining the path of the downstream conveyor.

6 Claims, 2 Drawing Sheets

ROUTING DEVICE FOR GROUPING TWO STREAMS OF FLAT OBJECTS, SUCH AS MAIL ENVELOPES, INTO ONE STREAM

BACKGROUND OF THE INVENTION

The invention relates to a routing device designed to allow two incoming streams of flat objects, particularly streams of mail envelopes, to be grouped together into a single stream, in which device the objects, entering the stream alternately according to which stream they originate from, are transmitted one after another as in the incoming stream. As is known, certain operations in the processing of flat objects within a processing assembly are compatible with object flow rates which are markedly higher than they are in other operations with which they are associated, particularly in the case of an assembly for processing mail envelopes. Thus, for example, the operations of reading addresses, labeling or printing related to these mail envelopes allow a high flow rate along a conveying path, for example of the order of six objects per second. This flow rate cannot be achieved in the de-stacking operations which have to be performed at the headend of the path, because these operations only allow a flow rate which is practically half as high.

This means that constructors of assemblies of this kind have to feed an item of treatment equipment, the object flow rate of which is high, from several slower items of supply equipment which are arranged in parallel so that their respective flow rates are summed at the entry to the high flow rate equipment.

In a known embodiment, a routing device allows successive flat objects, such as mail envelopes, from one supplier equipment item to be inserted between the flat objects originating successively from another supplier equipment item. To do this, the flat objects of rectangular appearance from each supplier equipment item travel along one of their long sides along conveying paths which join each supplier equipment item to the routing device. The flat objects leaving an equipment item one after another to be conveyed to the routing device are positioned between a broad belt known as the backing belt, against which the flat objects are pressed by one of their large faces and a press belt which is pressed against the backing belt along the length of the conveying path joining the supplier equipment item in question to the routing device.

SUMMARY OF THE INVENTION

One of the conveying paths followed by the flat objects from one of the supplier equipment items meets the other conveying path followed by the flat objects from the other equipment item at the routing device, and does so at a relatively large angle of incidence $\alpha$, for example an angle of the order of 45°. This therefore leads to significant deformation of the flat objects when they pass through the routing device, because for a short moment of time the flat objects from one of the equipment items are bent in half at an angle $\beta=\pi-\alpha$ which is the complementary angle to the angle of incidence. A solution of this kind is not truly satisfactory because the flat objects subjected to bending at the routing device while they are being conveyed may be damaged if they are not flexible enough or if they contain something really hard. Furthermore, in the latter incidence, it is possible that, in the absence of special steps, the hardware may become jammed and/or damaged. Patent document DE-21 45 270 discloses a routing device with two conveyors which converge symmetrically at a small angle toward a downstream conveyor which has the effect of limiting the inflection of the objects in the zone of convergence.

The object of the invention is to propose an even further improved routing device which allows two incoming streams of flat objects, particularly mail envelopes from two supplier equipment items to be grouped together, in which device the flat objects may have very varied thicknesses and hardnesses.

DESCRIPTION OF THE DRAWINGS

This objective is achieved by a routing device.

The invention, its features and its advantages are specified in the description which follows, in conjunction with the figures listed hereinbelow.

DESCRIPTION OF AN EXEMPLARY EMBODIMENT

Figure 1:
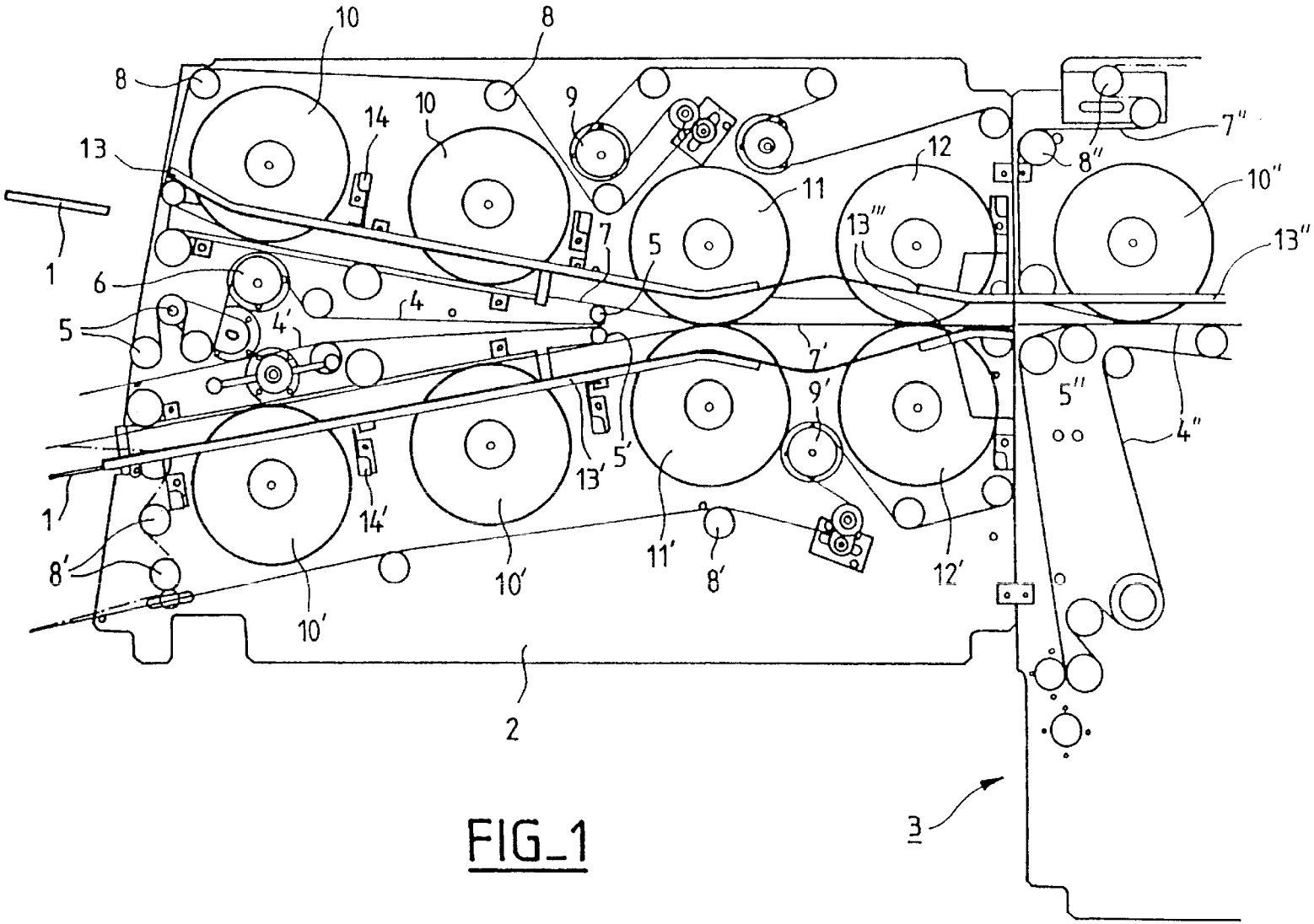
FIG. 1 presents a view from above of a routing device according to the invention, assumed to be placed upstream of an item of receiving equipment.

The routing device illustrated in FIG. 1 is intended to allow flat objects 1 of rectangular appearance, such as postal envelopes, transmitted by two object-processing equipment items, not depicted, to be grouped together with a view to transferring them to one same third, so-called receiving equipment item depicted partially to the right of the routing device in FIG. 1.

The objects 1 envisaged are, for example, envelopes, the usual sizes of which are between 14 and 40 centimeters long, 9 and 30 centimeters wide and between 0.15 and 32 millimeters thick. They may possibly be relatively soft, although in general they are somewhat rigid.

As already envisaged above, the third equipment item, reference 3, is, for example, an equipment item for reading the addresses on the envelopes, the only depicted part of which is a conveying arrangement designed to receive the envelopes.

The two items of processing equipment supplying the flat objects are not depicted, these are, for example, two de-stackers in the case where the objects are mail envelopes. Each of the two supplier equipment items is assumed to supply a stream of flat objects which travel at constant speed, along one of their two long sides and one after another. This movement is achieved, for example, by means of a conveying arrangement similar to the one depicted at the entry to the receiving equipment item.

In the proposed embodiment, it is assumed that the routing device is produced on a horizontal mounting plate 2. The flat objects arrive in a vertical position at that one of the two entries A1 or A2 of the routing device toward which they are conveyed, in a way not depicted, by the equipment items which supply them alternately. Alternatively, the routing device according to the invention may possibly be produced on a vertical mounting plate so as to allow the routing of flat objects which arrive in a horizontal position at the entries to the routing device toward which they are conveyed.

According to the invention, the routing device essentially comprises two arrangements for conveying flat objects, known as upstream arrangements, each serving one of the entries to the device and converging toward a common downstream conveying arrangement which itself serves an arrangement for conveying flat objects, known as the entry to the equipment item by means of which the receiving equipment item is served. In the embodiment presented, this entry conveying arrangement is shown borne by a different mounting plate than the one which bears the routing device proper. It is to be understood that at least part of this arrangement may alternatively be mounted on the mounting plate 2 of the routing device. Likewise, in the example depicted, it is assumed that part of the conveying arrangement associated with the entry A2 is located on another mounting plate located upstream of the mounting plate 2 and not depicted here.

In a preferred embodiment, the flat objects 1 arriving at one entry to the routing device are taken up by an upstream conveying arrangement in which the flat objects are held by gripping between a broad lateral belt, known as the backing belt which is fixed and acts as a reference, against which the flat objects are pressed, and a narrow press belt. Such a conveying arrangement is also provided at the entry to the receiving equipment item. The two upstream conveying arrangements and the entry conveying arrangement which are illustrated in FIG. 1 each comprise a motorized endless backing belt 4, 4' or 4" mounted in the conventional way on a set of pulleys. Each assembly comprises idling pulleys, such as the pulleys 5, 5' or 5" and drive pulleys such as the pulleys 6 or 6"; it allows the backing belt it bears to be kept firmly taut. Each backing belt serves as a reference support for the flat objects conveyed along the length of the conveying path where this backing belt is in contact with a press belt. Each of the backing belts 4, 4' or 4" here runs parallel to the mounting plate which bears it and to which it is perpendicular. Each one has a relatively large width, for example of the order of 20 centimeters, to allow the flat objects to rest securely against it via one of their large faces and allow these objects to be held perpendicular to the mounting plate. What this means is that the flat objects are positioned vertically as they travel through the routing device when the mounting plate is horizontal. Support guides 13, 13' 13", parallel to the belts along the conveying paths are therefore provided to hold the flat objects up as they travel along if these objects are likely to bend on account of their weight because of their flexibility or softness.

Insofar as the streams of flat objects entering the two entries A1 and A2 are intended to be grouped together into a single stream by the routing device so as to be forwarded to the receiving equipment item 3, it is preferably envisaged for the two so-called upstream conveying paths each of which serves one of the entries to the routing device, to be at the same level with respect to the mounting plate as the so-called downstream conveying path which extends between the zone at which these two upstream conveying paths converge and the entry conveying arrangement provided for the receiving equipment item 3.

Each of the press belts such as 7, 7' or 7" is intended to hold the flat objects pressed against the corresponding backing belt 4, 4' or 4", during conveying, that is to say along the so-called conveying path where it remains pressed against a backing belt. Each of these pressed belts is a motorized endless belt mounted on an assembly including pulleys mounted so that they are perpendicular to the mounting plate which bears them, like the pulleys of the assemblies on which the backing belts are mounted. As was the case with the backing belts, the pulleys of one assembly provided for one press belt are divided into idling pulleys such as 8, 8' and 8" and drive pulleys such as 9 and 9'.

A press belt is pressed against a backing belt for example in the so-called lower part of the middle section of this belt which is closest to the mounting plate on which the assembly of pulleys bearing these two belts is mounted. Pressing is achieved through the action of a series of elastically deformable free wheels referenced 10, 10' or 10", depending on the conveying arrangement, and which are mounted on fixed axles perpendicular to the mounting plate which bears them. In one embodiment, the hardness of these wheels is, for example, of the order of 55 Shore A.

These elastically deformable wheels are, for example, spoked wheels, of the low-pressure type, made of polyurethane, of the kind produced by the company COURBIS.

Each wheel is designed to press against a press belt, in the zone where this press belt presses against the backing belt and on the other side of this belt from this backing belt.

These elastically deformable wheels, through elastic deformation, absorb the differences in thickness that are likely to exist between the flat objects and, more specifically between two flat objects placed one after the other. Each of these wheels is mounted so that it can continue to bear constantly against the press belt with which it is associated, even when no flat object is gripped between this press belt in their vicinity.

In the proposed embodiment, the backing belts 4, 4' converge toward one another at the entry to the convergence zone where the so-called upstream conveying paths of the two upstream conveying arrangements meet the so-called downstream conveying path of the downstream conveying arrangement.

For conveying to be as uniform as possible regardless of the upstream conveying path via which a flat object arrives, it is envisaged that the two upstream paths, which are preferably intended to be straight, should develop symmetrically in a Y-shape with the smallest possible angle of separation with respect to the axis of the downstream path which follows them. The purpose of this is to reduce to a minimum the angle of inflection between each of the upstream paths and the downstream path which follows them and therefore to limit the inflection of a flat object as it passes through the convergence zone to a minimum value which is identical for all of the flat objects regardless of the upstream paths via which they are conveyed. In a preferred embodiment, the angle of the Y formed by the two upstream paths is set at a value not much different than 10°. However, this entails a specific mechanical arrangement of the constituent elements of the routing device and, in particular, of the arrangements regarding the upstream paths.

In the embodiment depicted in FIG. 1, the backing belts 4 and 4' each belonging to one of the upstream conveying arrangements are housed inside the space delimited by the two converging upstream paths, with their idling or driving pulleys, each of these two belts internally defining the boundary of one of these paths.

As a result of this, the corresponding two press belts 7 and 7' are on the outside of this space and each externally defines the boundary of one of the upstream paths. The wheels 10 and 10' which are associated with them are thus located outside the above-mentioned space and are distributed on one or other side of this space depending on which upstream conveying arrangement they belong to. One or more stepped rails 13 or 13' for guiding the envelopes extend along each upstream path on the same side as the press belt defining the boundary of this path. The fact that the rails are arranged in a stepped fashion with respect to the mounting plate on the supports 1' which bear them allows envelopes protruding above the belts at different heights because of their differences in size to be supported when these envelopes are being conveyed.

The backing belts meet at the confluence of the upstream paths, each looping back around a pulley 5 or 5', the diameter of which is chosen to be very small, so as to allow each envelope to be held by the backing belt against which it has been rested for as long as possible as it enters the zone of convergence between the upstream and downstream conveying paths.

The press belts 7 and 7' meet at a gripping point which constitutes the entry to the downstream path. Each of these two press belts rests, in this region against an elastically deformable wheel 11 or 11' which preferably has a greater hardness than the wheels of the upstream conveying arrangements, for example 65 Shore A, insofar as it does not need to deform as much as the latter wheels do because each of these two wheels 11, 11' has only to absorb half the thickness of a flat object.

The flat objects are then held in place by the two press belts 7 and 7' which grip them.

To re-reference the flat objects after they have passed through the gripping point, it is envisaged that an elastically deformable wheel 12 or 12' should press against each of the press belts 7, 7'. These are thus pressed one against the other and therefore hold the flat objects in place along the conveying path downstream of the routing device with collaboration with at least one pair of guide rails 13''' mounted on the mounting plate above the assembly formed by the wheels and the press belts and which extend on each side of the press belts along the downstream path, with a separation which slightly exceeds the maximum envisaged thickness of a flat object.

In a preferred embodiment, the wheel 12' is harder than the wheel 12 so that the press belt on which it rests is a substitute reference until this role of reference for the flat objects is taken over by the backing belt 4" which follows.

Figure 2:
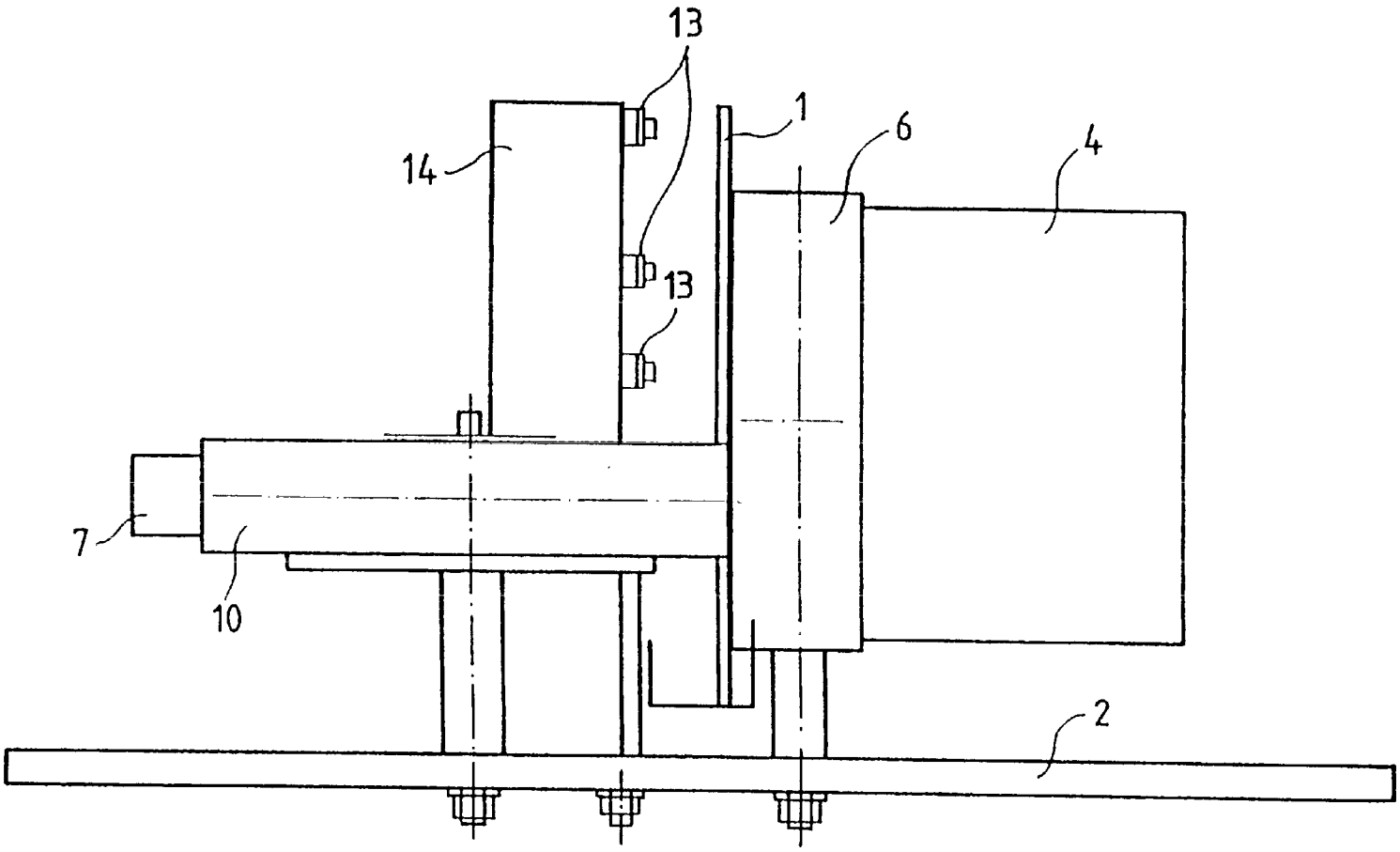
FIG. 2 presents a view from the left of part of the routing device according to the invention.

In a preferred embodiment illustrated in FIG. 2, there are provided rails which are stepped with respect to the mounting plate and designed to provide lateral support to the variously sized flat objects when these tend to fold over because of the weight of the part protruding, in each case, above the press belts with respect to the mounting plate. It is to be understood that the guide rails 13, 13' running along the outside of each of the upstream paths extend, coming on each side of the downstream path followed by the press belts, so that each meets one of the guide rails 13''' which is at the same level with respect to the mounting plate 2. In the example presented, each guide rail 13' is extended by a guide rail 13" provided in the receiving equipment item 3.

According to a known technique, the ends of the guide rails are shaped in such a way as to define entries of a flared appearance to make it easier for flat objects to be inserted between them and rest against them.

In the proposed embodiment, the flat objects passing through the downstream conveying arrangement are collected by the entry conveying arrangement of the receiving equipment item, it being understood that this arrangement may alternatively be included in the routing device according to the invention. Each flat object is gradually released by the press belts at the point where these diverge from one another; it then becomes inserted between the backing belt 4" and the press belt 7" under conditions corresponding to those which governed its insertion between the backing belt and the press belt of the upstream conveying arrangement via which it was received in the routing device according to the invention.

According to an alternative form of the invention, gripping by auxiliary press belt(s) may be employed for the envelopes passing between the routing device and the receiving equipment item at the point where the gripping provided by the press belts 7 and 7' is interrupted before further gripping is provided by the belts 4" and 7".

According to a preferred alternative form of the invention, the press belt 7 may possibly be extended beyond the mounting plate 2 of the routing device to loop back to the pulleys borne by the mounting plate of the receiving equipment item 3.

The speeds of travel of the backing belts 4, 4', 4" and of the press belts 5, 5' and 5" are assumed to be identical and are designed to allow a flow rate of flat objects that corresponds to that of the receiving equipment item, the flow rate of which is assumed to be higher than that of the equipment items positioned upstream of the routing device. The intended spacing between the flat objects in the downstream conveying path, or more precisely at the point where the path enters the receiving equipment item, governs that of the objects in the two upstream conveying paths, the latter flow rate being practically twice that of the former.

The routing device thus allows flat objects supplied alternately to each of its two entries A1 and A2 to be conveyed at one same given pace which leads to these flat objects being supplied one after another to a receiving equipment item at a pace which is twice the pace imposed at the entry.

As indicated earlier, the stresses, particularly in terms of bending, which are applied to the flat objects conveyed are reduced to a minimum by the routing device insofar as these flat objects follow a path which is practically straight within this device where the downstream conveying path is practically in line with each of the two upstream conveying paths. This therefore makes it possible to obtain a high flow rate at the exit of the device with a reduced risk of damaging the objects and internally blocking the flow of objects through the device.

What is claimed is:

1. A routing device intended to allow two incoming streams of flat objects (1) to be grouped into a single stream of flat objects, comprising two upstream conveyors on which the two incoming streams of flat objects are respectively conveyed and which converge symmetrically at a small angle toward a downstream conveyor on which the single stream of flat objects is conveyed in such a way that the conveying paths defined by the two upstream conveyors form a Y-shaped structure with the conveying path defined by the downstream conveyor, said conveyors each comprising two belts (7, 4; 7', 4') defining a conveying path which is preferably straight and between which said flat objects are held by gripping along said conveying path, wherein the two belts of each upstream conveyor comprise a press belt (7; 7') stretched over elastically deformable wheels (10, 11, 12, 10', 11', 12') with fixed axles and a backing belt (4; 4') against which the press belt presses, and wherein the press belts (7, 7') of the upstream conveyors meet at a gripping point constituting the entry to the downstream conveyor and at which they are pressed against one another by two elastically deformable wheels (11, 11') with fixed axles pressing one against the other, these two press belts being pressed one against each other downstream of the gripping point for defining the path of the downstream conveyor.

2. The device as claimed in claim 1, in which the two press belts (7, 7') are pressed one against the other downstream of the gripping point by two other elastically deformable wheels (12, 12') with fixed axles pressing one against the other.

3. The device as claimed in claim 2, in which said two other elastically deformable wheels (12, 12') have a different hardness.

4. The device as claimed in claim 1, in which said elastically deformable wheels (11,11',12,12') are spoked low pressure wheels.

5. The device as claimed in claim 2, in which said elastically deformable wheels (11,11',12,12') are spoked low pressure wheels.

6. The device as claimed in claim 3, in which said elastically deformable wheels (11,11',12,12') are spoked low pressure wheels.

* * * * *